US005184854A

United States Patent [19]

Chen

[11] Patent Number: 5,184,854

[45] Date of Patent: Feb. 9, 1993

[54] ELECTROMAGNETIC LOCK

[76] Inventor: Mavis Chen, No. 396 Ke-Nan St., Taipei, Taiwan

[21] Appl. No.: 829,255

[22] Filed: Feb. 3, 1992

[51] Int. Cl.[5] ..... E05C 19/16

[52] U.S. Cl. ..... 292/251.5; 292/DIG. 53; 411/522

[58] Field of Search ..... 292/251.5, DIG.53; 411/522

[56] References Cited

U.S. PATENT DOCUMENTS 4,141,108 2/1979 Busse ..... 411/522 X
4,703,962 11/1987 Kelly et al. ..... 292/251.5
4,720,128 1/1988 Logon, Jr. et al. ..... 292/251.5
4,871,204 10/1989 Cook et al. ..... 292/251.5
5,016,929 5/1991 Frolov ..... 292/251.5

*Primary Examiner*—Richard E. Moore
*Attorney, Agent, or Firm*—Morton J. Rosenberg; David I. Klein

[57] ABSTRACT

An electromagnetic lock comprised of an electromagnetic core fastened inside a casing to hold a coil unit in the grooves thereon, said casing being secured to a door frame or jamb, a armature plate connected to a door, and a control circuit to connect a power supply to said coil unit causing it to be energized for locking up with said armature plate, or to disconnect said power supply from said coil unit permitting said electromagnetic core to unlock from said armature plate.

8 Claims, 4 Drawing Sheets

ELECTROMAGNETIC LOCK

BACKGROUND OF THE INVENTION

The present invention relates to an electromagnetic lock. More particularly, the present invention relates to such an electromagnetic lock which is simple in structure, easy and inexpensive to manufacture, and which can be flexibly made in the desired size.

A conventional electromagnetic lock is generally comprised of an electromagnet fastened to a fixed door frame or jamb, and a strike (armature) plate attached to a movable door. The electromagnet is connected to a power supply by a control circuit. Connecting the power supply to the electromagnet causes the door to be locked when closed; disconnecting the power supply from the electromagnet causes the door to be unlocked.

Conventionally, an electromagnet is generally made from hundreds of silicon steel plates which are connected together through the process of welding or by screws, forming into an electromagnetic core. Then, a well-prepared coil is inserted in the electromagnetic core and sealed with a resin. After setting of the resin, the electromagnetic core thus obtained is reprocessed into an electromagnet. An electromagnet made according to the aforesaid manufacturing process may gather rust easily at the connecting areas among the silicon steel plates thereof. Another disadvantage of this electromagnet is its low structural strength. Once it is damaged, its holding force will be greatly reduced. Further, the aforesaid electromagnet manufacturing process will cause environmental pollution problem.

SUMMARY OF THE INVENTION

The present invention has been accomplished to eliminate the aforesaid disadvantages. One advantage of the present invention is that the electromagnetic core is made from a unitary conductive magnetic material which makes installation easy, provides high structural strength and does not gather rust easily. Another advantage of the present invention is that the coil unit is made from an coil covered with a resin through the process of injection molding, and therefor, the coil unit provides a smooth outer surface. Still another advantage of the present invention is that a magnetic eraser circuit is provided to eliminate residual magnetism, which eliminates the use of an intermediate substance in between the electromagnet and the armature plate, so that the electromagnetic lock maintains a constant holding force. Still another advantage of the present invention is that the electromagnetic core which is made from a conductive magnetic material can be conveniently flexibly made into any of a variety of sizes. Further, two electromagnets may be formed into an electromagnetic lock to increase the holding force.

According to the present invention, an electromagnetic lock which is generally comprised of an electromagnetic core which has a coil unit fastened therein, and an armature plate. The coil unit is energized when electric power is connected, causing the electromagnetic core to lock up with the armature plate. When electric power is disconnected, the electromagnetic core and the armature plate are unlocked. A capacitor is provided to instantaneously discharge electric charges for erasing residual magnetism.

BRIEF DESCRIPTION OF THE DRAWINGS

FIG. 1-1 is a partly enlarged view of the fastening plate;

FIG. 2-1 is a cross section of the electromagnetic core of the second embodiment of the electromagnetic lock according to the present invention;

DETAILED DESCRIPTION OF THE PREFERRED EMBODIMENTS

Figure 1:
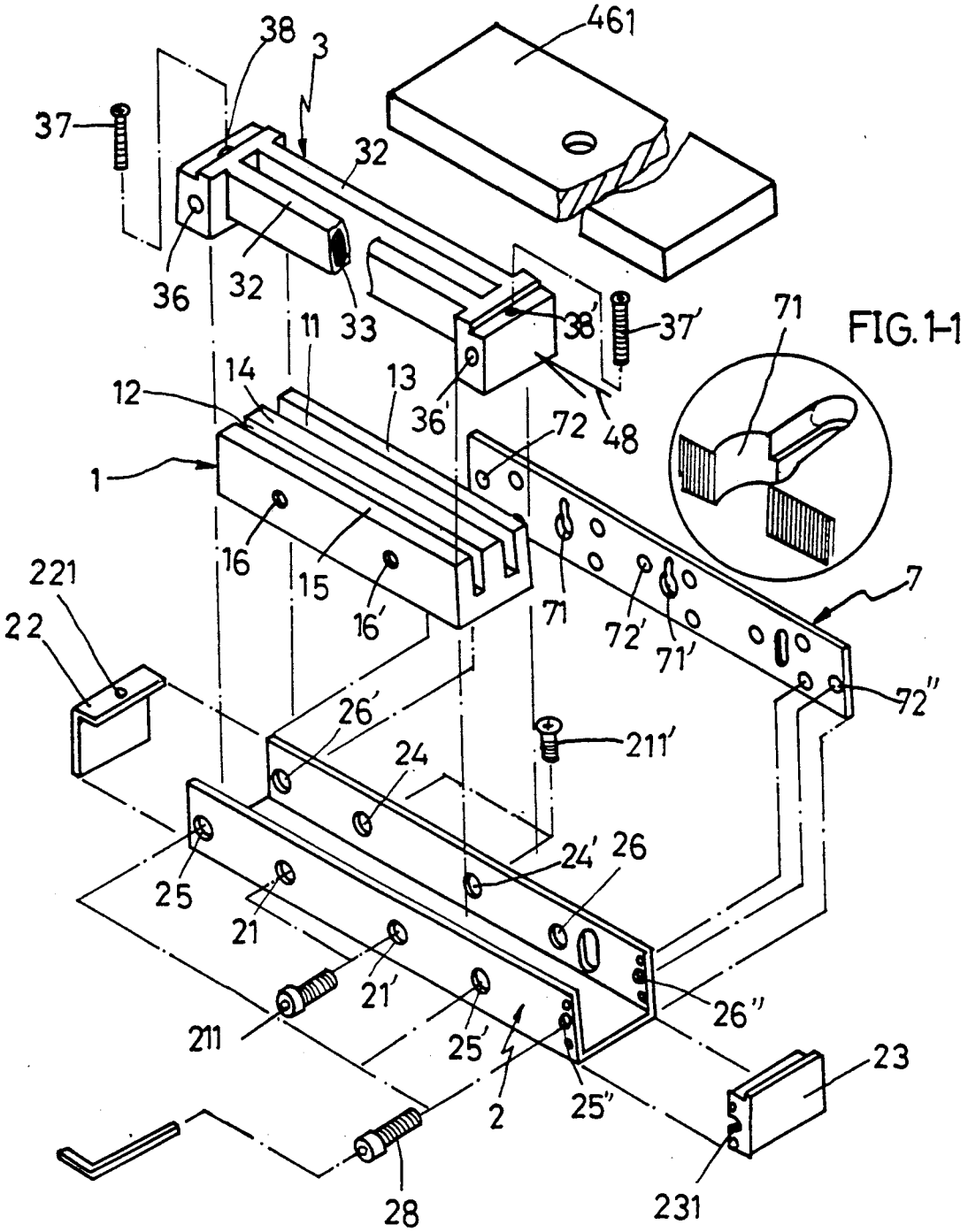
FIG. 1 is an exploded view of a first embodiment of the electromagnetic lock according to the present invention.

Referring to FIG. 1, an electromagnetic core 1 is made from a conductive magnetic material in an elongated shape, having parallel grooves 11, 12 longitudinally disposed thereon for mounting a coil unit 3. Once electric power is connected to the coil unit 3, the electromagnetic core 1 is energized to produce a magnetic force. One advantage of the electromagnetic core 1 is that it produces low heat energy when energized. Therefore, the electromagnetic core 1 provides a long service life. After having been fastened to the electromagnetic core 1, the coil unit 3 and the electromagnetic core 1 are received inside a casing 2. By inserting screws 211 through holes 21 on the casing 2 into bolt holes 16, 16' on the electromagnetic core 1 at one side, one side of the electromagnetic core 1 is fixed to the casing 2. The opposite side of the electromagnetic core 1 is secured to the casing 2 by inserting screws 211' through holes 24, 24' on the casing 2 into holes (not shown) on the opposite side of the electromagnetic core 1. The screws 211' are simultaneously inserted through holes 71, 71' on a fastening plate 7 to secure it to the casing 2. Elongated screws 28 are respectively inserted through holes 25, 25', 25'', and holes 36, 36' on the coil unit 3, holes 26, 26', into holes 72, 72', 72''' on the fastening plate 7. The screw which inserted through the hole 25'' is simultaneously inserted through a hole 23'' on a side plate 23 and then into the hole 72'' on the fastening plate 7, and therefore, the side plate 23 is secured in place. By inserting a screw 37 through a hole 221 on another side plate 22 into a hole 38 on the coil unit 3 and inserting another screw 37' into the hole 38', the screws 28 in the holes 36, 36' are protected from being detached from the outside.

Figures 1, 2:
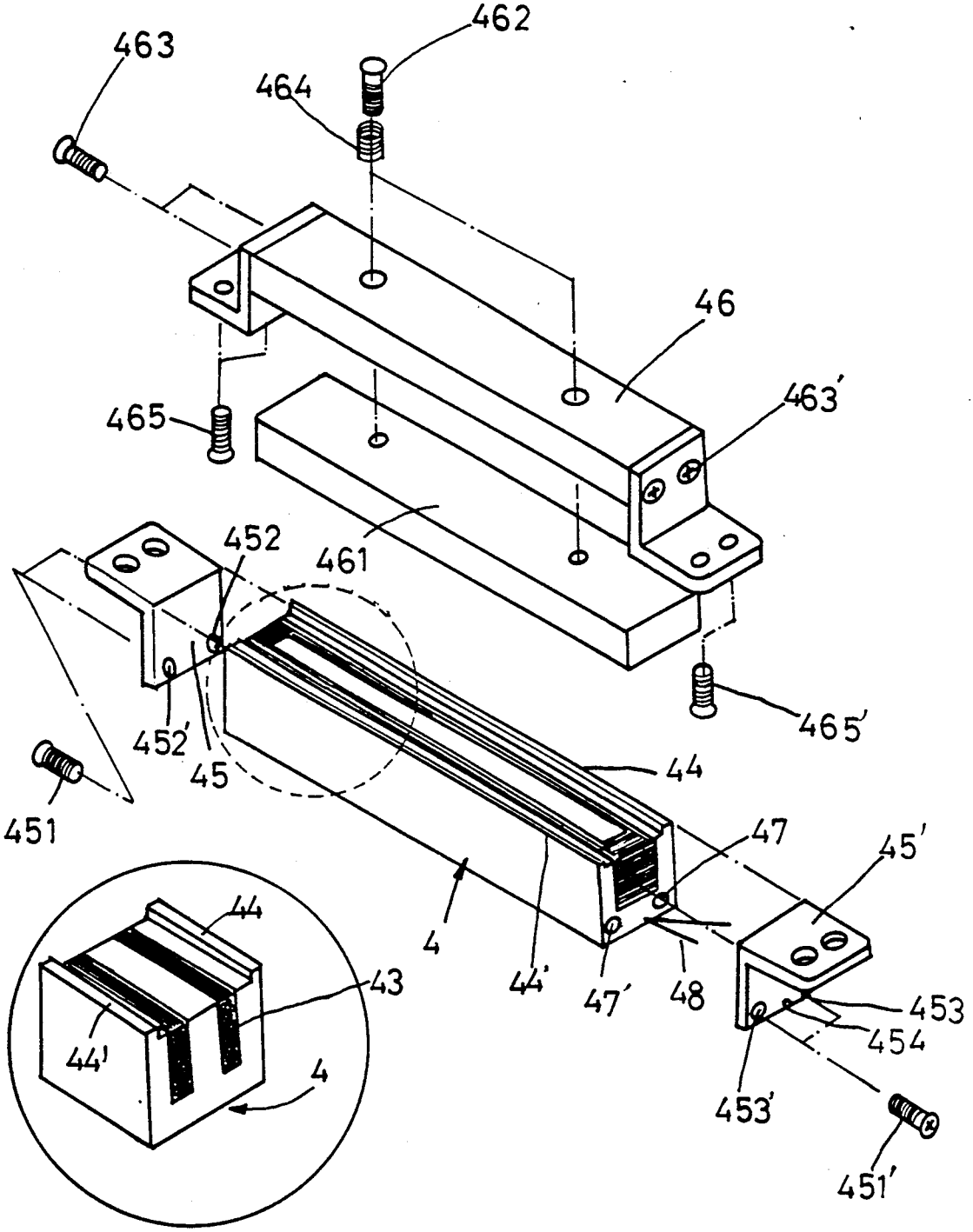
FIG. 2 is a second embodiment of the electromagnetic lock according to the present invention.
Figure 3:
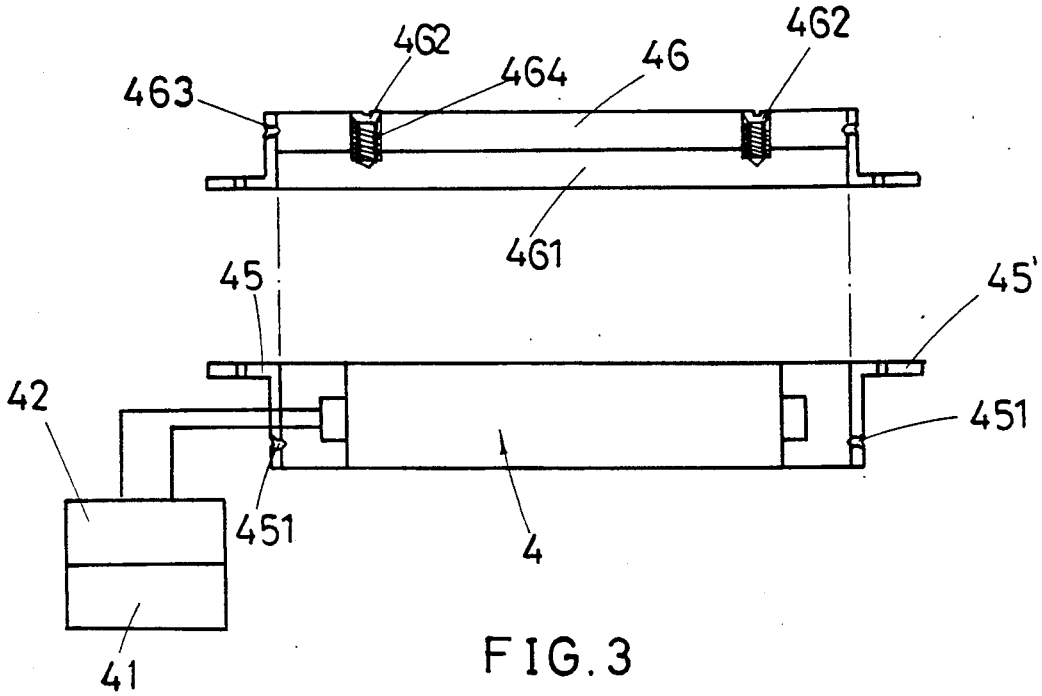
FIG. 3 is an assembly view of the second embodiment of the electromagnetic lock according to the present invention.

Referring to FIGS. 2, 2-1 and 3, therein illustrated is an alternate form of the present invention, the coil unit 43 is fastened inside the electromagnetic core 4 between the two opposite side walls 44, 44' thereof and sealed by resin. The two opposite ends of the electromagnetic core 4 are attached with two fastening plates 45, 45' respectively. By inserting screws 451, 451' through holes 452, 452', 453, 453' on the fastening plates 45, 45' into holes 47, 47' on the two opposite end walls of the electromagnetic core 4, the two fastening plates 45, 45' are firmly secured to the electromagnetic core 4, permitting leading wire 48 to be extended out through holes 454'. By means of the fastening plates 45, 45', the electromagnetic core 4 can be conveniently secured to a jamb by screws. Referring to FIG. 2 again, an armature plate 461 is secured to a mounting plate 46 by screws 462 and springs 464, which mounting plate 46 is further secured to a door frame by screws 463, 463', 465, 465'. Therefore, a door can be controlled by means of the operation of the armature plate 461 and the electromagnetic core 4. When electric power is connected, the two side walls 44, 44' of the electromagnetic core 4 are connected to the armature plate 461 causing a door to be locked. When electric power is off, the spring coil 464 pull the armature plate 461 outwards, causing the electromagnetic core 4 to disconnect from the armature plate 461, and therefore, the door is unlocked.

Referring to FIG. 1 again, the coil unit 3 has an intermediate through hole 31 for inserting an elongated intermediate rail 14 of the electromagnetic core 1, and two elongated side rails 32, 32' respectively inserted into the two parallel grooves 11, 12. The coil 33 of the coil unit 3 is covered with a resin through the process of injection molding. In an alternate form, the coil 33 may be wound on a coil holder and inserted in the electromagnetic core 4, and then, sealed with the resin.

Referring to FIGS. 2, 2-1 and 3 again, the coil unit 43 is fastened inside the electromagnetic core 4 and covered with an insulating resin. When electric power is connected, the electromagnetic core 4 and the armature plate 461 are attracted together causing a door to be locked. The electromagnetic core 4 is further connected to a magnetic eraser circuit 42. The magnetic eraser circuit 42, when triggered, eliminates any residual magnetism between the electromagnetic core 4 and the armature plate 461, causing the electromagnetic core 4 to be disconnected from the armature plate 461 when electric power is disconnected.

Figure 4:
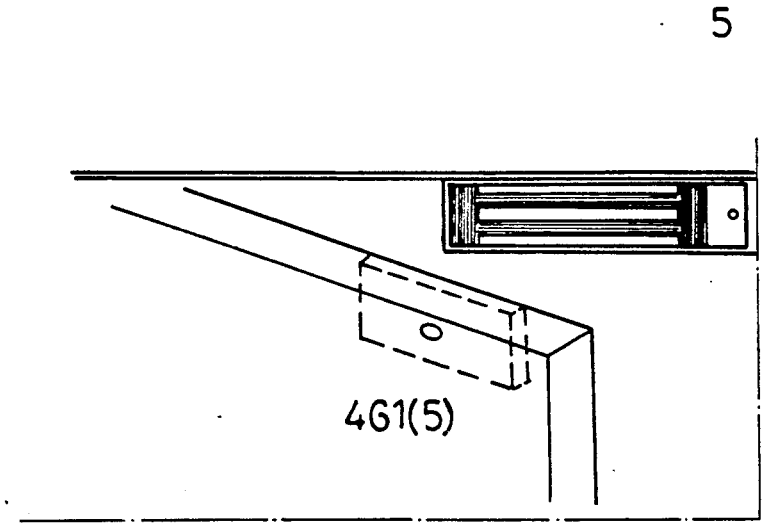
FIG. 4 is a schematic drawing showing an installation example of the present invention.

Referring to FIG. 4, an electromagnet 5 may be used instead of the armature 461. As illustrated, a first electromagnet 5 is fastened to an upper rail while a second electromagnet 5 or an armature plate 461 is secured to a door panel, that is to say that the electromagnetic lock of the present invention can be formed of two electromagnets 5, or an electromagnet 5 and an armature plate 461. When electric power is connected, the electromagnet 5 or the armature plate 461 is attracted by the electromagnetic core 4 to lock up the door.

Figure 5:
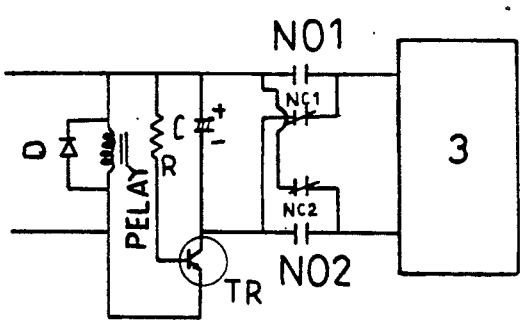
FIG. 5 is a circuit diagram of the magnetic eraser circuit according to the present invention.

Referring to FIG. 5, therein illustrated is a circuit diagram of the electric circuit of the present invention. As illustrated, power supply is connected to a relay causing it to be activated, and then, connected to a transistor TR for controlling the electromagnetic core 4 via a resistor R. Working voltage from the transistor TR is further sent through normal opened switches No. 1, No. 2 (relay dry contact), to energize the coil unit 3, and therefore, the electromagnetic lock is locked. When to unlock the electromagnetic lock, a capacitor C discharges electric charges through NC1, NC2 to the coil unit 3. While the capacitor C discharging of electric charges, the transistor TR prohibits reverse flow of electric current to power supply, and therefore, residual magnetism is reduced.

Figure 6:
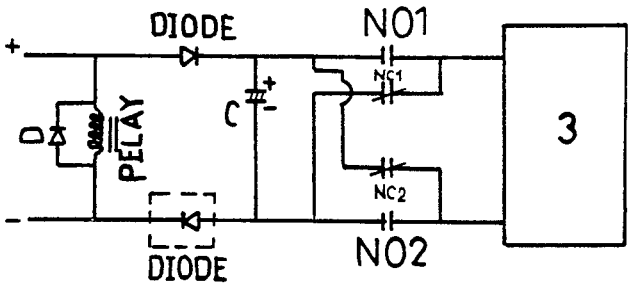
FIG. 6 is an alternate form of the circuit diagram of the magnetic eraser circuit of the present invention.

Referring to FIG. 6, a diode may be used instead of the transistor TR in FIG. 5. As illustrated, the diode is connected between the relay and the capacitor C at the positive or negative line of power supply in a reverse phase, to prevent from reverse flow of electric current during the discharging operation of the capacitor C through NC1, NC2.

Figure 7:
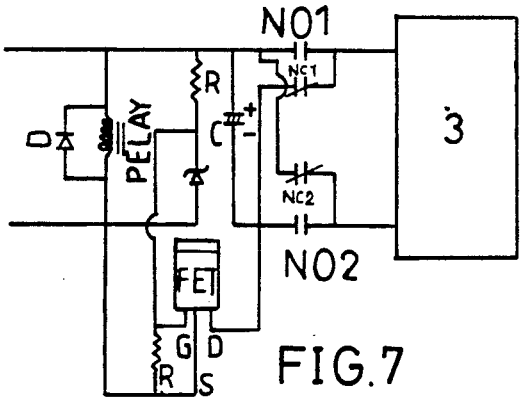
FIG. 7 is another alternate form of the circuit diagram of the magnetic eraser circuit of the present invention.

Referring to FIG. 7, a zener diode may also be used to provide a bias voltage to the gate of FET, so that the capacitor C discharges through NC1, NC2 to erase magnetism when electric power disconnected. Further, SCR, TRIAC may be used instead of FET.

What is claimed is:

1. An electromagnetic lock comprising:

an electromagnetic core, said electromagnetic core being integratedly made from a conductive magnetic material in a unitary piece and an elongated shape and having elongated grooves thereon;

a coil unit, said coil unit comprised of an electromagnetic coil and being fastened in said elongated grooves on said electromagnetic core;

a U-shaped casing having a base member and a pair of opposing side walls for insert of said electromagnetic core, said casing being formed from a channel plate having two opposite ends thereof secured respectively to two end plates, said two end plates being to firmly secure said electromagnetic core in said casing, at least one of said two end plates having at least one end secured to either of said side walls of said casing by a mounting screw and fastened thereto by a locking screw inserted through a top surface thereof positionally located perpendicular to said mounting screw for positionally locking said mounting screw and preventing displacement thereof;

an armature plate fastened to a door panel, said armature plate being made from a conductive magnetic material; and, a control circuit;

wherein said control circuit is controlled to connect a power supply to energize said electromagnetic coil causing said electromagnetic core and said armature plate to be secured to each other, or disconnect said power supply from said electromagnetic coil causing said electromagnetic core and said armature plate to be released.

2. The electromagnetic lock according to claim 1, wherein said casing is secured to a mounting plate through one of said side walls by screw attachments.

3. The electromagnetic lock according to claim 2, wherein said mounting plate has fastening holes respectively formed in the contour of a keyhole for inserting screws in securing said casing, said fastening holes each having a recessed retainer surface portion at the inside for holding the head of the screw being inserted therein.

4. The electromagnetic lock according to claim 1, wherein said magnetic core comprises two opposite side walls for holding said coil unit, said two opposite side walls includes at least one having a top edge protruding over said coil unit for capturing said armature plate under said top protruding edge so as to prevent it from being displaced.

5. The electromagnetic lock according to claim 1, wherein said electromagnetic core is made from an elongated electromagnet having a E-shaped cross section with an elongated rail longitudinally disposed at a middle for mounting said coil unit.

6. The electromagnetic lock according to claim 1, wherein said electromagnetic core is mounted on a door frame, said armature plate being secured to said door panel at a location corresponding to said electromagnetic core for locking.

7. The electromagnetic lock according to claim 1, wherein said control circuit is comprised of a relay to connect a power supply to energize said electromagnetic coil, and a magnetic eraser circuit comprised of a capacitor to discharges electric charges for erasing magnetism upon disconnection of power supply.

8. The electromagnetic lock according to claim 7, wherein said magnetic eraser circuit further comprises a transistor, or a diode, or a FET, or a SCR or a TRIAC coupled to a power supply through a relay and a capacitor for discharge through a pair of normally open switches coupled to said coil unit for providing a reverse flow of electric current to said relay.

* * * * *